US008231520B2

(12) United States Patent
Cho et al.

(10) Patent No.: US 8,231,520 B2
(45) Date of Patent: Jul. 31, 2012

(54) ROUND WINDOW DRIVING TRANSDUCER FOR EASY IMPLANTATION AND IMPLANTABLE HEARING DEVICE HAVING THE SAME

(75) Inventors: Jin Ho Cho, Buk-Gu Daegu (KR); Il Yong Park, Chungcheongnam (KR); Kyu Yup Lee, Jung-Gu Daegu (KR)

(73) Assignee: Kyungpook National University Industry-Academic Corporation Foundation, Daegu (KR)

( * ) Notice: Subject to any disclaimer, the term of this patent is extended or adjusted under 35 U.S.C. 154(b) by 1014 days.

(21) Appl. No.: 12/195,605

(22) Filed: Aug. 21, 2008

(65) Prior Publication Data

US 2009/0131742 A1 May 21, 2009

(30) Foreign Application Priority Data

Nov. 20, 2007 (KR) ..... 10-2007-0118300

(51) Int. Cl.
*H04R 25/00* (2006.01)

(52) U.S. Cl. ..... 600/25

(58) Field of Classification Search ..... 600/25; 607/55–57; 381/312–331
See application file for complete search history.

(56) References Cited

U.S. PATENT DOCUMENTS 3,783,864 A 1/1974 Moller
4,006,796 A 2/1977 Coehorst
4,276,449 A 6/1981 Sawafuji
5,099,947 A 3/1992 Guggenberger et al.
5,299,176 A 3/1994 Tibbetts
5,913,815 A 6/1999 Ball et al.
7,239,069 B2 7/2007 Cho
7,618,450 B2 * 11/2009 Zarowski et al. ..... 623/10
2005/0141739 A1 6/2005 Juneau et al.

* cited by examiner

*Primary Examiner* — Samuel Gilbert
(74) *Attorney, Agent, or Firm* — Daniel A. Thomson; Emerson Thomson Bennett LLC

(57) ABSTRACT

The present invention relates to a round window driving transducer for easy implantation and an implantable hearing device having the same. The round window driving transducer is implantable in the round window of the cochlea in the middle ear cavity, and has excellent high frequency characteristics, which can assist patients with sensorineural hearing loss to hear sound better. The round window driving transducer can be placed inside the middle ear cavity, radiate sound with high efficiency, and be implanted by surgery using a fixing part formed with shape memory alloy, shape memory resin, or a bendable spring structure. Further, the round window driving transducer can overcome problems of the prior art, such as a difficult surgery and low vibration efficiency, which would inevitably occur when floating mass transducers are implanted in a drilled groove in the bone or when various types of piezoelectric transducers are implanted in the round window.

12 Claims, 16 Drawing Sheets

ROUND WINDOW DRIVING TRANSDUCER FOR EASY IMPLANTATION AND IMPLANTABLE HEARING DEVICE HAVING THE SAME

CLAIM OF PRIORITY

This application claims the benefit of Korean Patent Application No. 2007-0118300, filed on Nov. 20, 2007 in the Korean Intellectual Property Office, the disclosure of which is incorporated herein by reference.

BACKGROUND OF THE INVENTION

1. Field of the Invention

The present invention relates to a round window driving transducer for easy implantation and an implantable hearing device having the same. More particularly, the round window driving transducer of the present invention is designed to be easily implanted in the round window of the cochlea in the middle ear cavity, and has excellent high frequency characteristics, which can effectively assist patients with sensorineural hearing loss to hear sound better.

2. Description of the Related Art

In general, about 10% of the world population has various types of hearing loss. About 8% of those with hearing loss are deaf people whose auditory threshold is too high, whereas the remainder is suffering from mild, moderate or severe hearing loss.

In order to compensate for the moderate hearing loss and the severe hearing loss with the auditory threshold ranging from 55 dB HL to 90 dB HL, various designs of implantable middle ear hearing devices, which can be totally implanted without being exposed, have been proposed.

For example, various implantable middle ear hearing devices have been disclosed in U.S. Pat. Nos. 5,800,336, 5,558,618, 6,277,148, 5,360,338, 5,277,694, 5,772,575, 5,951,601 and so on. In such implantable middle ear hearing devices, a vibrator is regarded as the most important part. In a fully-implantable middle ear hearing device, the vibrator is required not only to be highly efficient but also to be small and adequate for implantation so as to be easily inserted into the middle ear.

A floating mass transducer (U.S. Pat. No. 5,800,336) of Ball et al. is currently commercialized. In spite of many advantages, the above identified transducer has a drawback in that low and high frequency bands except for a middle frequency band have a low gain. Further, this transducer cannot be used in a Magnetic Resonance Imaging (MRI) system that has a strong magnetic field.

Since the transducer is suspended from the ossicle by means of a clip, a portion of the ossicle in contact with the transducer could be weakened by the load of the transducer suspending therefrom, thereby loosening the coupling between the transducer and the ossicle.

It is expected that several types of transducers for implantable middle ear hearing devices available from Otologics, Implex AG and St. Croix have drawbacks such as a difficult implant surgery and prolonged surgery time. This is because a transducer has to be fixed at one end thereof to the wall of the middle ear cavity before the other end thereof is brought into contact with the ossicle in order to be implanted inside the middle ear cavity, and then precision adjustment has also to be performed using small screws.

According to U.S. Pat. No. 5,772,575 to Lesinski et al. and U.S. Pat. No. 5,498,226 to Lenkauskas, a screw housing, with a piezoelectric vibrator disposed therein, is pushed into the inner ear by a drilling operation. However, these approaches are disadvantageous because of the leakage of perilymph and infection in the surgery.

US Patent Application Publication No. 2005/0020873A1 by Berrang et al. discloses a transducer having a construction similar to that of the floating mass transducer of Ball as described above. The transducer of Berrang et al. is constructed to vibrate a bone portion adjacent to the three semicircular canals, and includes a multilayer piezoelectric element with at least one vibration-reflecting mass at one end thereof and a transducer housing defining an enclosure.

The transducer of Berrang et al. having a diameter ranging from 2 mm to 6 mm and a length ranging from 2 mm to 5 mm is larger than the transducer of Ball et al., which has a diameter 1.8 mm and a length 2 mm. This is because the transducer of Berrang et al. is not directly mounted inside the middle ear or to the cochlea but is implanted in a bone portion between the superior and lateral semicircular canals by drilling through the temporal bone.

The vibrator used in the transducer of Berrang et al. needs a simpler surgery than the vibrator used in the floating mass transducer of Ball et al. However, since the vibrator transmits vibration signals through the bone without direct contact with the entrance of the inner ear or the cochlea, the vibration signals are attenuated while vibration energy is being transmitted to the entrance of the inner ear through the three semicircular canals and the vestibular organ.

In consequence, when the transducer of Berrang et al. is employed in a fully-implantable middle ear hearing device, it consumes much more power than the transducer of Ball et al. Further, since grooves formed in the outer surface of the transducer in order to improve osseointegration, the transducer has to directly contact the bone when it is vibrating in the bone. This, however, may degrade vibration performance. Consequently, in terms of efficiency, this type of transducer is substantially improper for the fully-implantable middle ear hearing device since it consumes a large amount of battery power.

Typically, sound is transmitted in the order of the outer ear, the tympanic membrane, the ossicle, the oval window of the cochlea, the endolymph and the round window. Considering the operating principle of the cochlea, sound entering the round window prior to the oval window can also be recognized by the vibration of the basilar membrane inside the cochlea. That is, many scholars have proved that the sound can be properly recognized even if they are transmitted in the order of the round window, the endolymph, the oval window and the ossicle. U.S. Pat. No. 5,360,388, invented by Spindel et al. of James Madison University, discloses a small electromagnetic transducer, which is attached to the round window and is driven by electric signals from an electromagnetic coil. The problems of the electromagnetic transducer are that it consumes too much power but also is not compatible with the MRI system.

Recently, V. Colletti (Italian scholar) et al. proposed a round window driving system in which a floating mass transducer is wrapped in a biocompatible tissue such as a soft fascia so as to be fixed in contact with the round window membrane. Here, the vibrator is constructed to freely vibrate the round window membrane in response to external electric signals.

This feature is significantly distinct from the transducer of Berrang et al., which is constructed to vibrate the bone, as is disclosed in US Patent Application Publication No. 2005/0020873A1. The round window niche is carefully drilled with a drill of 3 mm to 5 mm, and then the round window membrane is exposed so that it can be seen with the eye. Next, the round window membrane is covered with a thin piece of fascia, on which a vibrating cylinder is then placed, and finally, the cylinder is fixed by wrapping the entire part thereof with a fascia. It is reported according to clinical test results that this method greatly improved hearing ability.

However, according to V. Colletti's method as described above, a surgery has to be performed on a wide area since a large amount of the entrance of the round window of the cochlea is drilled so that the round window membrane can be seen with the eye when the floating mass transducer is implanted in the round window. Since the floating mass transducer cannot be fixed without being wrapped in the fascia, there is a risk that the cylinder type transducer may be moved out of the round window by external impact or shaking.

Furthermore, the round window membrane may be damaged when it is being drilled, and the process of wrapping the transducer in the fascia to prevent loosening or separation also requires surgeons to have high level of concentration that is burdensome.

SUMMARY OF THE INVENTION

The present invention has been made to solve the foregoing problems with the prior art.

Therefore, the present invention is directed to a round window driving transducer for easy implantation and an implantable hearing device having the same, in which the transducer of the present invention is more easily implantable in the round window and more sensitive than conventional transducers and, particularly, has characteristics beneficial to people with sensorineural hearing loss, whose hearing degrades in high frequency ranges.

The present invention is also directed to a round window driving transducer for easy implantation and an implantable hearing device having the same, in which the transducer of the present invention is implantable in the middle ear cavity, is constructed to irradiate sound with high efficiency, and is very easily implantable with a minimal surgery using a fixing part formed with shape memory alloy, shape memory resin (e.g., plastic) or a bendable spring structure.

The present invention is further directed to a round window driving transducer for easy implantation and an implantable hearing device having the same, which can overcome problems of the prior art, such as a difficult surgery and low vibration efficiency, which would inevitably occur when floating mass transducers are implanted in a drilled groove in the bone or when various types of piezoelectric transducers are implanted in the round window.

According to an aspect of the present invention, there is provided a round window driving transducer for easy implantation. The round window driving transducer includes: a biocompatible housing having an inner space, an opening in a top portion thereof and a through-hole in a lateral side thereof; a piezoelectric vibrator placed inside the housing, and having a connecting pin at an end thereof; a biocompatible membrane in contact with the connecting pin, wherein the biocompatible membrane is vibrated by the piezoelectric vibrator to apply vibration to a round window membrane; a membrane cover covering a top surface of the biocompatible housing, and having a plurality of fixing pins extending from inner circumferential portions thereof; power cords connected from outside through the through-hole of the biocompatible housing so as to supply power to the piezoelectric vibrator; and a hermetic sealing terminal hermetically sealing the through-hole of the housing through which the power cords are inserted into the housing.

According to another aspect of the present invention, there is provided a round window driving transducer for easy implantation. The round window driving transducer includes: a biocompatible housing having an inner space, an opening in a top portion thereof and a through-hole in a lateral side thereof; a piezoelectric vibrator placed inside the housing, and having a connecting pin at a end thereof; a biocompatible membrane in contact with the connecting pin, wherein the biocompatible membrane is vibrated by the piezoelectric vibrator to apply vibration to a round window membrane; a membrane cover covering a top surface of the biocompatible housing, wherein the membrane cover comprises a plurality of lever grooves extending from inner circumferential portions to outer circumferential portions thereof, spaced apart from each other at a predetermined interval, and elastic support pins each provided inside a respective one of the lever grooves; a plurality of push levers each inserted into a respective one of the lever grooves and connected to a respective one of the elastic support pins; power cords connected from outside through the through-hole of the biocompatible housing to supply power to the piezoelectric vibrator; and a hermetic sealing terminal hermetically sealing the through-hole of the housing through which the power cords are inserted into the housing.

According to a further aspect of the present invention, there is provided a round window driving transducer for easy implantation. The round window driving transducer includes: a biocompatible housing having an inner space, an opening in a top portion thereof and a through-hole in a lateral side thereof; an inner housing placed inside the biocompatible housing, wherein the inner housing has an inner space and an opening in a top portion thereof; an electromagnetic vibrator fitted inside the inner housing; a biocompatible membrane in contact with a top portion of the electromagnetic vibrator, wherein the biocompatible membrane is vibrated by the electromagnetic vibrator to apply vibration to a round window membrane; a membrane cover covering a top surface of the biocompatible housing, and having a plurality of fixing pins extending from inner circumferential portions thereof; power cords connected from outside through the through-hole of the biocompatible housing to supply power to the electromagnetic vibrator; and a hermetic sealing terminal hermetically sealing the through-hole of the housing through which the power cords are inserted into the housing.

The round window driving transducer may further include a vibration-transmitting member coupled to the biocompatible membrane, in which the vibration-transmitting member helps the vibration from the biocompatible membrane be transmitted to the round window membrane.

The vibration-transmitting member can be an elastic body made of silicone.

Further, the vibration-transmitting member may include: a helical spring fixed to the top surface of the biocompatible housing; and a finishing portion coupled to a distal end of the helical spring.

Here, the finishing portion can be made of biocompatible silicone.

Alternatively, the finishing portion can be a contact cap made of titanium or biocompatible material.

The fixing pins can be made of shape memory alloy or shape memory resin, in which the shape memory alloy contains titanium and nickel, and the shape memory resin is composed of polymer.

The round window driving transducer may further include a plurality of exudate drains. The exudate drains may include: a plurality of housing drains formed in outer circumferential portions of the biocompatible housing; a plurality of membrane drains formed in outer circumferential portions of the biocompatible membrane, corresponding to the housing drains; and a plurality of cover drains formed in outer circumferential portions of the membrane cover, corresponding to the housing drains and the membrane drains. The housing drains, the membrane drains and the cover drains can form the exudate drains when the biocompatible housing, the biocompatible membrane and the membrane cover are combined with each other.

The piezoelectric vibrator can be a single piezoelectric element or a multilayer piezoelectric element.

Here, the piezoelectric element can be made of piezoelectric material capable of generating high efficiency vibration and have an area less than 1 $mm^2$ and a length less than 2 mm.

Further, the electromagnetic vibrator may includes: a pair of magnetic members placed inside the inner housing so as to reduce an influence from an external magnetic field, the magnetic members stacked on each other, with same polarity ends thereof facing each other; a pair of elastic members supporting the magnetic members, the first one of the elastic members placed on an underside of a lower one of the magnetic members, and the second one of the elastic members placed on a top surface of an upper one of the magnetic members; and a solenoid coil placed inside the inner housing and fitted around the magnetic members.

Further, the fixing pins may have a quadrangular or circular cross section.

According to yet another aspect of the present invention, there is provided an implantable hearing device, which is constructed with the round window driving transducer for easy implantation as described above.

The round window driving transducer for easy implantation and the implantable hearing device using the same according to the present invention have the following effects:

Firstly, the transducer is provided with a fixing structure made of shape memory alloy, which can be transformed to bend outward by body temperature. As a result, when the transducer is inserted into the entrance of the round window, the fixing structure bends outward so as to fix quickly and tightly the transducer to the entrance of the round window, thereby facilitating an implant surgery without screws.

Secondly, the round window driving transducer provides a structure that does not damage the round window membrane while transmitting vibration from the membrane, generated by a piezoelectric element or an electromagnetic mechanism, to the round window membrane through the vibration-transmitting member. In consequence, there are advantages such as improved efficiency, less battery power consumption in an implantable middle ear hearing device and safety.

Thirdly, since the round window driving system has much lower load effect than the oval window driving system, high frequency vibration transmission efficiency of the round window driving system is much greater than that of the oval window driving system. Accordingly, the round window driving system can provide a transducer that can be used for patients with sensorineural hearing loss.

Fourthly, when a conventional transducer is implanted to drive the round window, the round window may be closed or exudate, if any, may contaminate the membrane of the transducer. The round window driving transducer of the present invention can be prevent these potential problems and thus is safe even if used for a long time.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EXEMPLARY EMBODIMENTS

Hereinafter, a round window driving transducer and an implantable hearing device having the same according to the present invention will be described more fully with reference to the accompanying drawings, in which exemplary embodiments thereof are shown. In the accompanying drawings, FIG. 1A is a schematic view illustrating the round window of the cochlea before a round window driving transducer according to the present invention is implanted therein, FIG. 1B is a schematic view illustrating the round window of the cochlea after the round window driving transducer according to the present invention is implanted therein, FIG. 2 is a perspective view illustrating the contour of a round window driving transducer according to the first embodiment of the present invention, FIG. 3A is a perspective view illustrating a round window driving transducer according to the second embodiment of the present invention, prior to implantation in the round window of the cochlea, FIG. 3B is a perspective view illustrating the round window driving transducer according to the second embodiment of the present invention, after implantation in the round window of the cochlea, in which fixing pins are transformed, FIG. 4 is an exploded perspective view of FIG. 3A, and FIG. 5 is a schematic view illustrating the round window driving transducer according to the second embodiment of the present invention, which is implanted in the round window.

Figure 1A:
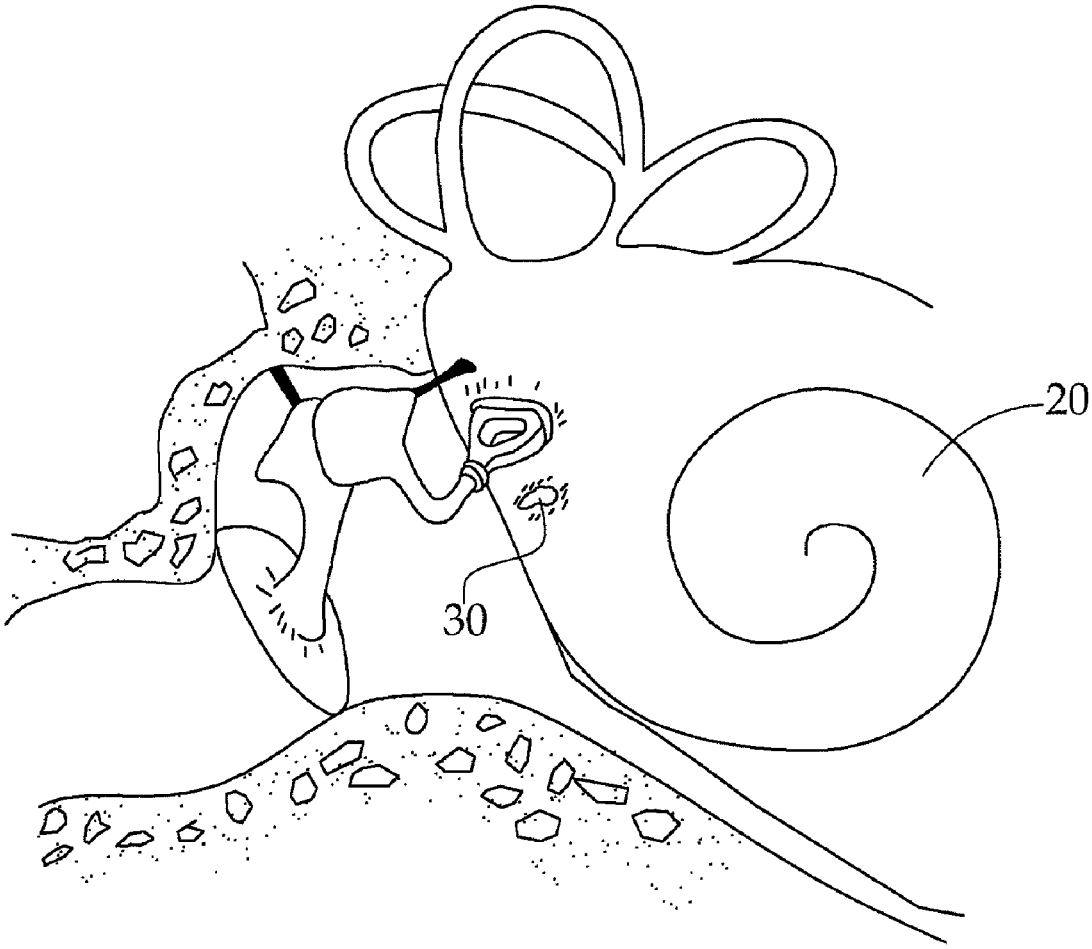
FIG. 1A is a schematic view illustrating the round window of the cochlea before a round window driving transducer according to the present invention is implanted therein.
Figure 1B:
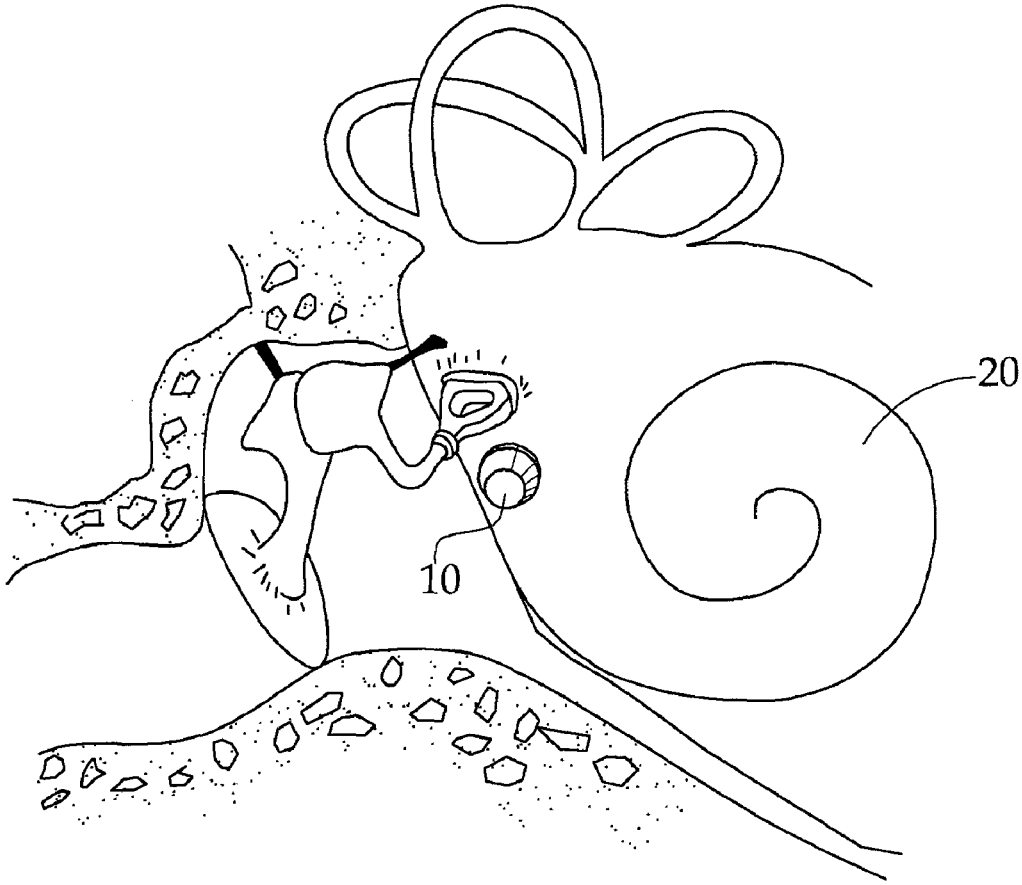
FIG. 1B is a schematic view illustrating the round window of the cochlea after the round window driving transducer according to the present invention is implanted therein.

Referring to FIGS. 1A and 1B, a round window driving transducer 10 according to an embodiment of the present invention is implanted in the round window 30 inside cochlea 20. Unlike conventional transducers, the transducer 10 can be easily inserted into the round window 30 by minimal procedures so as to be implanted inside the middle ear cavity. Further, the transducer 10 can provide an amplitude 200 nm or more corresponding to a vibration displacement, which can sufficiently vibrate the cochlea 20 of people with moderate to severe hearing loss (with the auditory threshold ranging from 55 dB HL to 100 dB HL).

Below, a detailed description will be given of exemplary embodiments of the round window driving transducer according to the present invention with reference to the accompanying drawings, in which the same or similar reference signs are used throughout the different drawings to designate the same or similar components.

Figure 2:
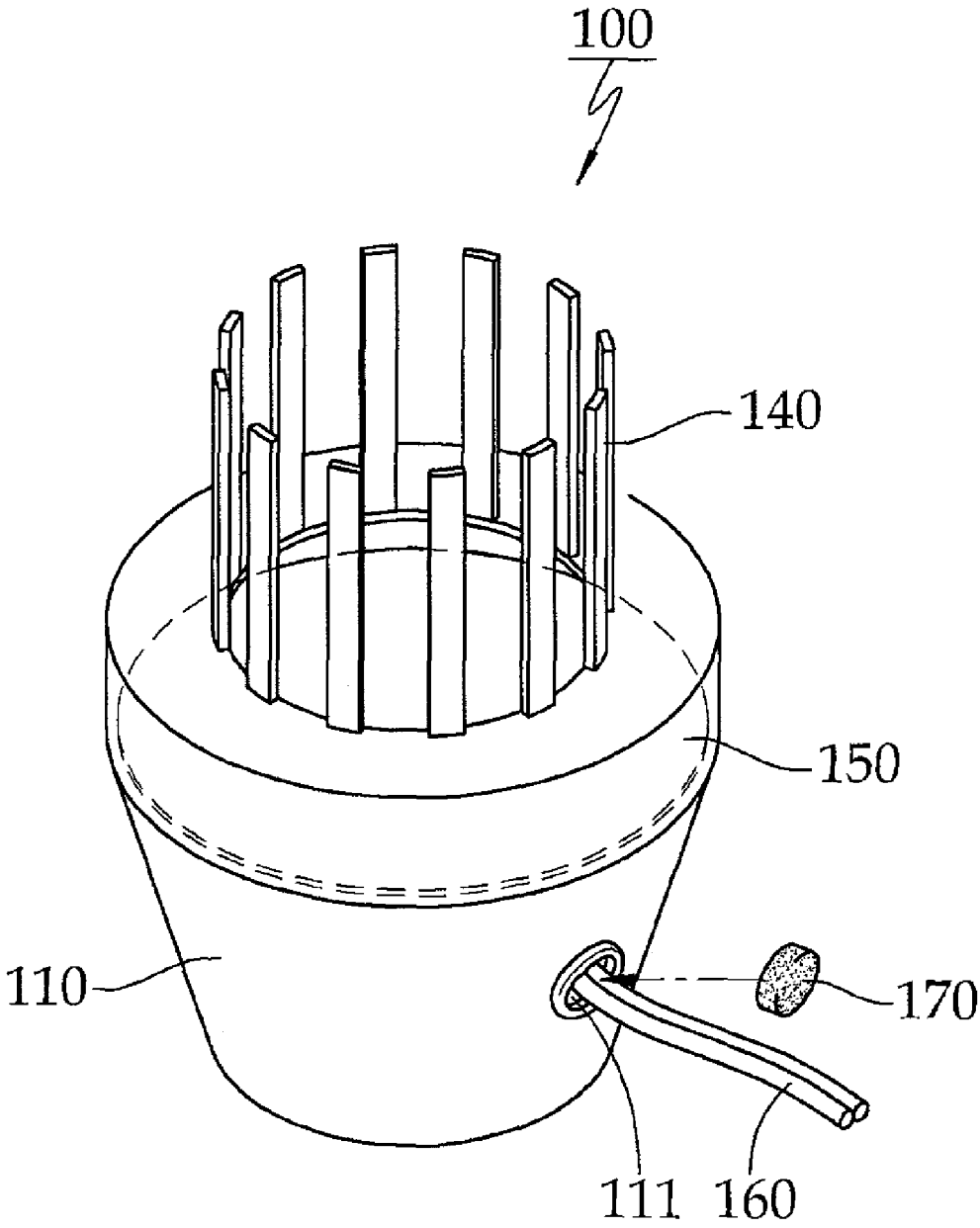
FIG. 2 is a perspective view illustrating the contour of a round window driving transducer according to the first embodiment of the present invention.
Figure 3A:
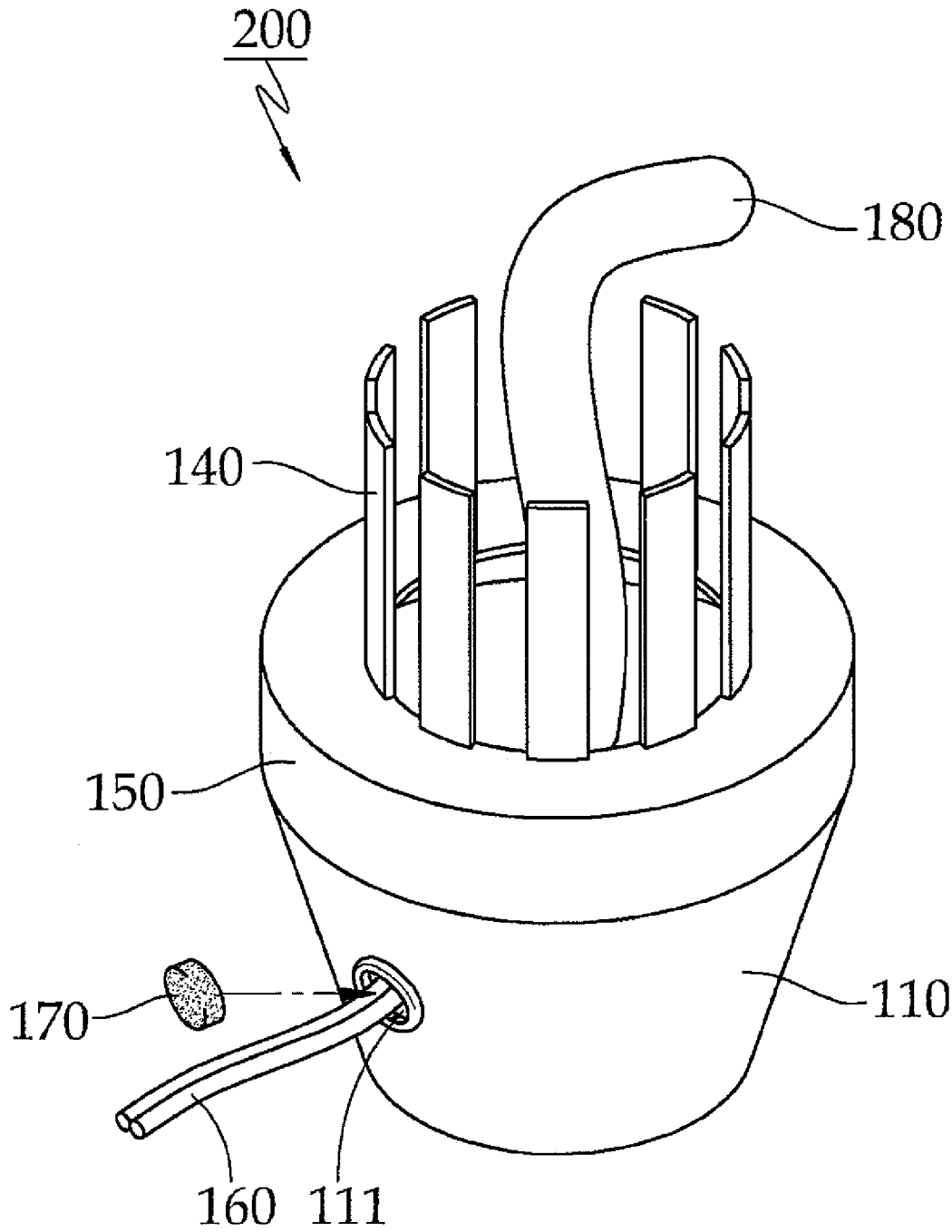
FIG. 3A is a perspective view illustrating a round window driving transducer according to the second embodiment of the present invention, prior to implantation in the round window of the cochlea.
Figure 3B:
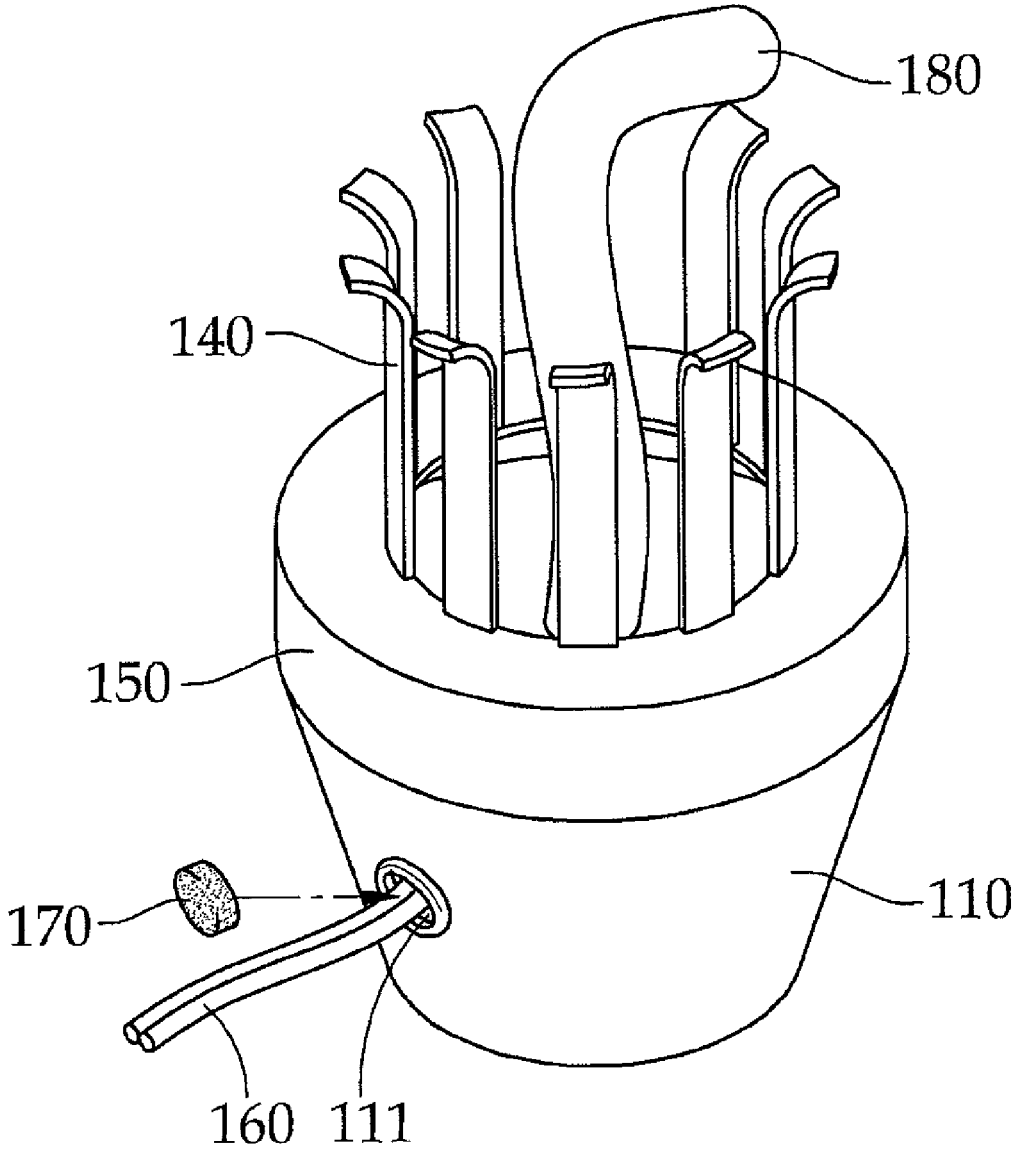
FIG. 3B is a perspective view illustrating the round window driving transducer according to the second embodiment of the present invention, after implantation in the round window of the cochlea, in which fixing pins are transformed.
Figure 4:
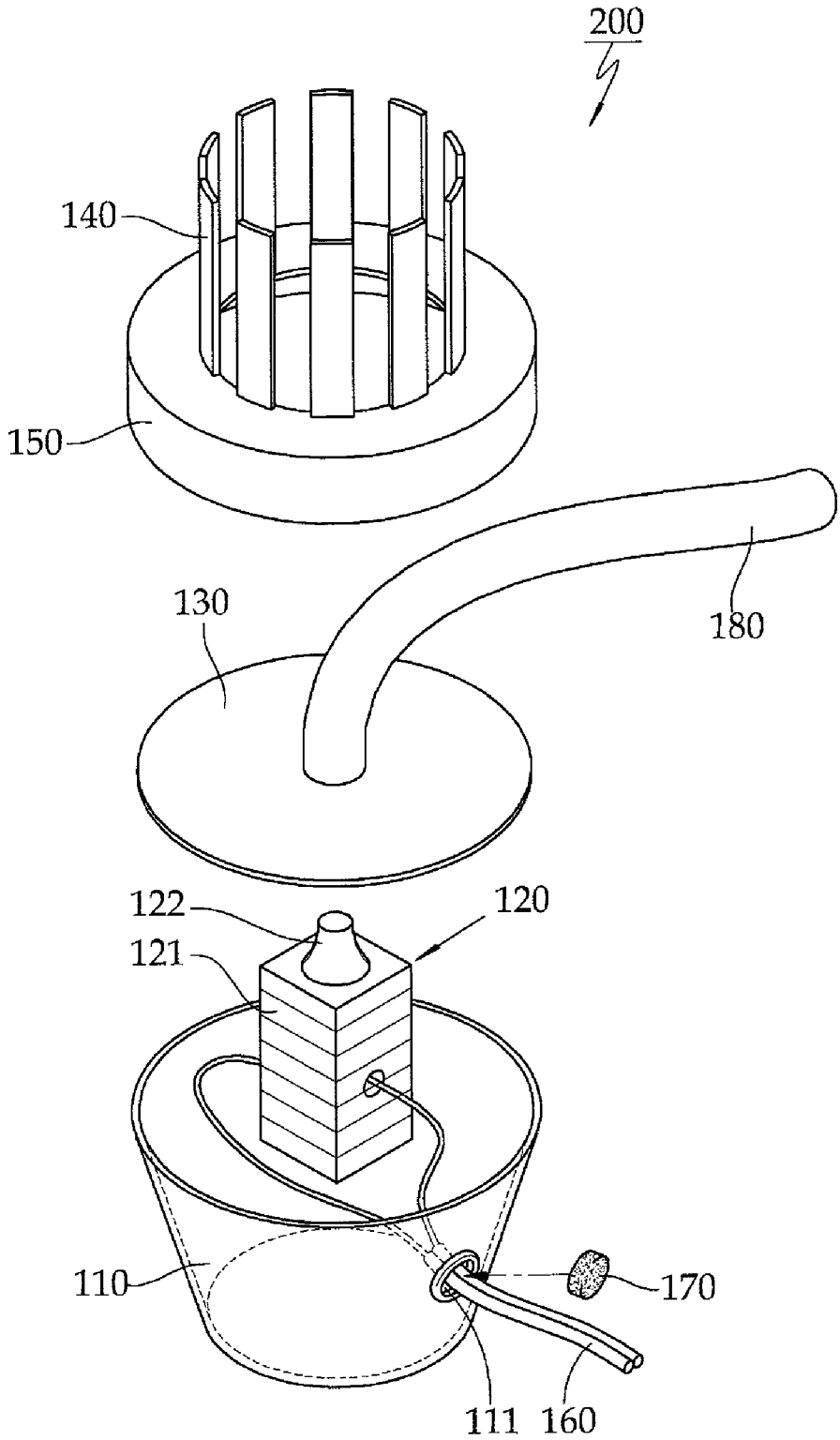
FIG. 4 is an exploded perspective view of FIG. 3A.
Figure 5:
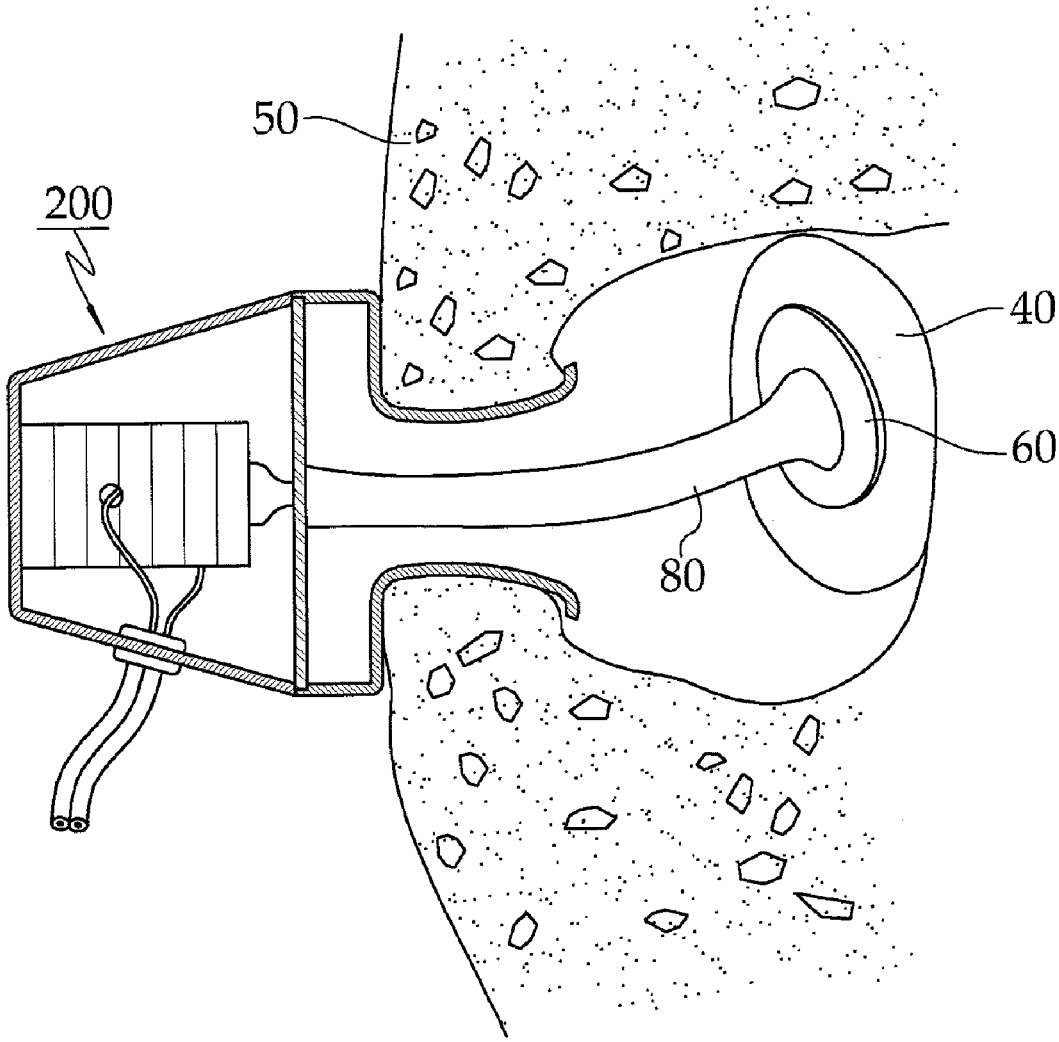
FIG. 5 is a schematic view illustrating the round window driving transducer according to the second embodiment of the present invention, which is implanted in the round window.

Referring to FIG. 2 together with FIGS. 4 and 5, a round window driving transducer 100 according to the first embodiment of the present invention includes a biocompatible housing 110 having an inner space, a piezoelectric vibrator 120, a biocompatible membrane 130, a membrane cover 150, power cords 160 and a hermetic sealing terminal 170. The biocompatible housing 110 has an opening in the top portion thereof and a through-hole 111 in a lateral side thereof. The piezoelectric vibrator 120 is placed inside the housing 110 and has a connecting pin 122 at one end thereof. The biocompatible membrane 130 is in contact with the connecting pin 122 and is configured to be vibrated by the piezoelectric vibrator 120 and apply vibration to the round window membrane 40 (see FIG. 5). The membrane cover 150 covers the top surface of the biocompatible housing 110 and has a plurality of fixing pins 140 extending from the inner circumference thereof. The power cords 160 are connected from outside through the through-hole 111 of the biocompatible housing 110 to supply power to the piezoelectric vibrator 120. The hermetic sealing terminal 170 hermetically seals the through-hole 111 of the housing 110 through which the power cords 160 are inserted into the housing 110.

The round window driving transducer 100 of this embodiment has substantially the same construction as a round window driving transducer 200 of the second embodiment which will be described later, except that a vibration-transmitting member 180 is not attached to the biocompatible membrane 130.

The membrane cover 150 surrounds the outer side of the biocompatible membrane 130 to be isolated from the outer wall surface 50 (see FIG. 5) of the round window, so that the biocompatible membrane 130 can better vibrate. With the membrane cover 150, the transducer 100 can better contact the outer wall surface 50 (see FIG. 5) of the round window.

The fixing pins 140 can be made of shape memory material such as shape memory alloy or shape memory resin (e.g., plastic). The shape memory alloy can be composed of titanium and nickel, and shape memory resin can be polymer. The shape memory alloy is globally recognized as scientific name "nitinol," which is biocompatible when implanted in a living organism.

The fixing pins 140 made of shape memory alloy are designed to remember a predetermined geometry that is bent outward at a body temperature 25° C. or more but can be transformed into a straight shape by cooling. When the straight fixing pins 140 are implanted in the round window 30 (see FIG. 1), they will restore the original bent geometry by the body temperature so as to fix the transducer.

The shape memory material is not limited to nitinol, but it is to be understood that the round window driving transducer of the present invention can employ any other alloys or the shape memory resin as long as they are biocompatible and can remember the original geometry at body temperature.

The membrane cover 150 with the fixing pins 140 extending therefrom is made of shape memory material, and its size is determined in consideration of the area and depth of the round window 30 (see FIG. 1). The membrane cover 150 can preferably have an inside diameter ranging from 1.3 mm to 2.6 mm and a length ranging from 1 mm to 2.5 mm, and the fixing pins 140 can preferably have a thickness ranging from 0.1 mm to 0.3 mm.

Each of the fixing pins 140 may have a quadrangular or circular cross section.

With the fixing pins 140, the transducer 100 can be easily inserted into and fixed to the entrance of the round window.

The piezoelectric vibrator 120 is constructed with a piezoelectric member 121 that is a single piezoelectric element or a multilayer piezoelectric element. The piezoelectric member 121 may preferably have an area less than 1 mm and a length less than 2 mm, and be made of piezoelectric material such as lead zirconate titanate (PZT) or lead-magnesium-niobium-titanate (PMNPT), which can generate high efficiency vibration.

Inner components of the transducer 100 of this embodiment are completely sealed by the biocompatible housing 110 and the biocompatible membrane 130, and power cords 160 connected to the piezoelectric vibrator 120 pass through the hermetic sealing terminal 170, which provides a perfect hermetic seal.

The round window driving transducer 100 of this embodiment is constructed in such a fashion that sound generated by the vibration of the biocompatible membrane 130 drive the round window membrane 40 (see FIG. 5) without the vibration-transmitting member 180 which will be described later. The round window driving transducer 100 of this embodiment can be configured as a receiver for a small implantable middle ear hearing device, which generates sound rather than directly transmitting vibration, and the low frequency response of the round window driving transducer 100 may be a little inferior to that of the transducer 200 of the second embodiment, which will be described later. However, the round window driving transducer 100 can be sufficiently used as sound generating transducer, a miniature speaker implanted in the middle ear cavity where sound coupling is perfect, or a transducer for driving the round window.

Referring to FIGS. 3 and 4, a round window driving transducer 200 according to the second embodiment of the present invention has substantially the same construction as the foregoing round window driving transducer 100 of the first embodiment, except that the vibration-transmitting member 180 attached to the biocompatible membrane 130 is further provided.

The vibration-transmitting member 180 serves to efficiently transmit vibration from the biocompatible membrane 130 to the round window membrane 40 (see FIG. 5), and can preferably be constructed with an elastic member made of, for example, silicone. This is because the position of the membrane 40 (see FIG. 5) inside the round window niche, with respect to the surface of the entrance of the round window 30 (see FIG. 1A), is different for every person. Since the vibration-transmitting member 180 made of a soft silicone member can be provided with a sufficient margin, it can be cut by surgical scissors according to the length of the round window membrane 40 (see FIG. 5) just before an implant surgery is performed.

Referring to FIG. 5, the distal end of the vibration-transmitting member 180, cut by surgical scissors, is placed on the surface of the round window membrane 40 by ensuring biocompatibility with a fascia film 60, which is wound on the former or laid on the latter. Then, the transducer 200 of the present invention is pushed into the entrance of the round window so that it can be spontaneously fixed to the round window.

Figure 6A:
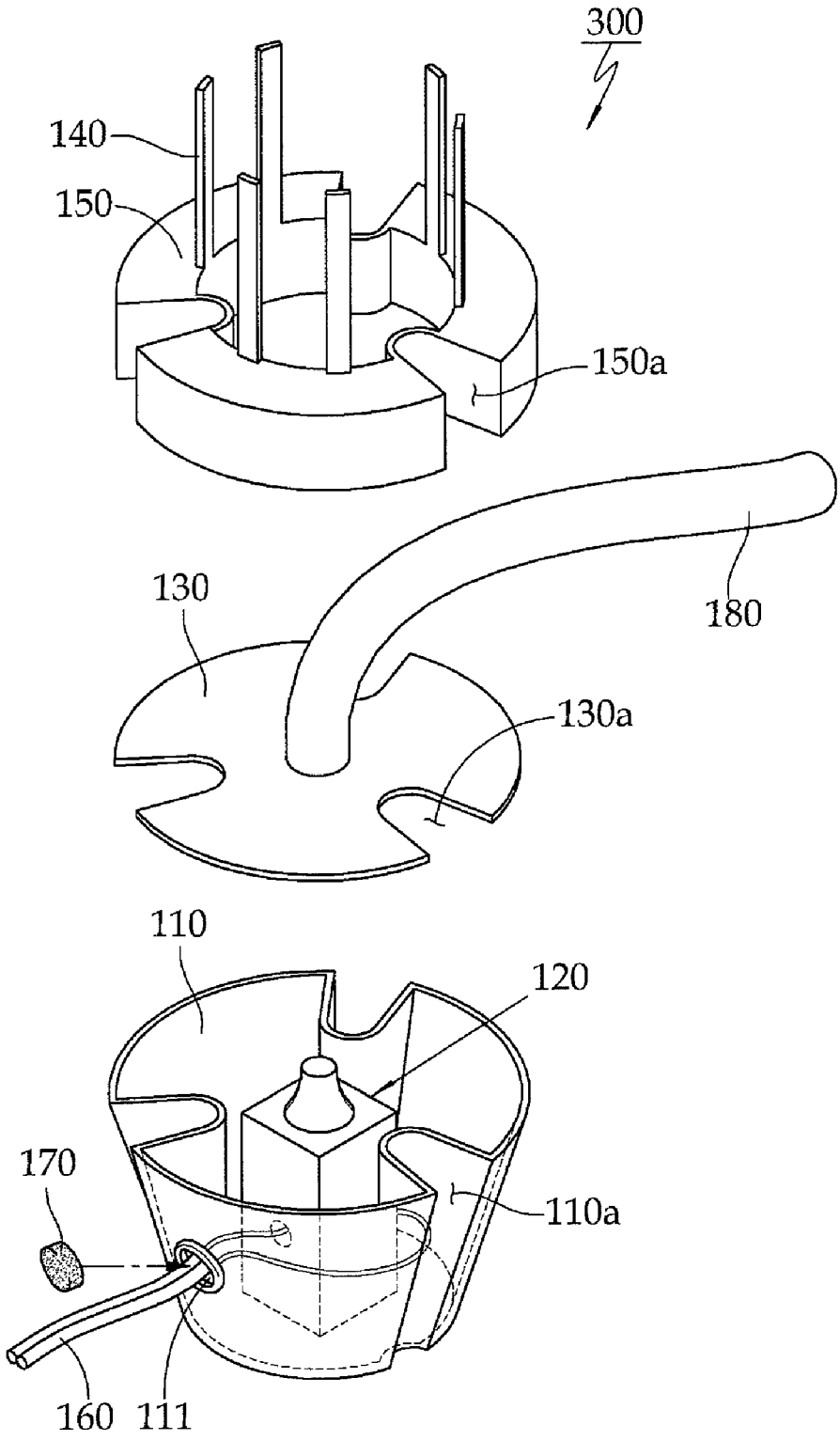
FIG. 6A is an exploded perspective view illustrating the construction of a round window driving transducer according to the third embodiment of the present invention.
Figure 6B:
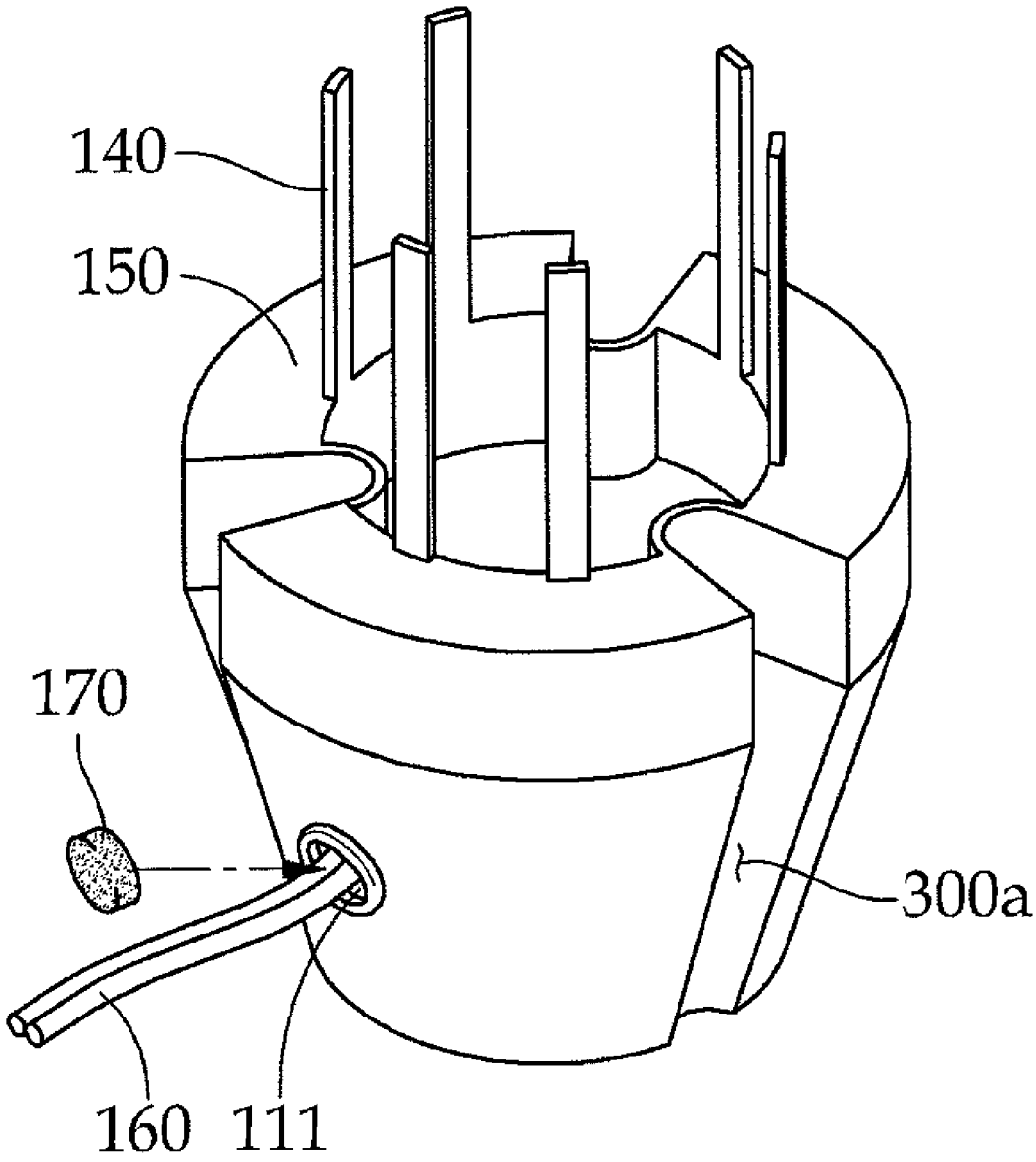
FIG. 6B is an assembled perspective view of FIG. 6A.

In the accompanying drawings, FIG. 6A is an exploded perspective view illustrating the construction of a round window driving transducer 300 according to the third embodiment of the present invention, and FIG. 6B is an assembled perspective view of FIG. 6A.

Referring to FIGS. 6A and 6B, the round window driving transducer 300 of this embodiment has substantially the same construction as the foregoing round window driving transducer 200 of the second embodiment, except that exudate drains 300*a* are formed.

In the round window driving transducer 300 of this embodiment, a plurality of housing drains 110*a* are formed in the outer circumference of the biocompatible housing 110, a plurality of membrane drains 130*a* are formed in the outer circumference of the biocompatible membrane 130, corresponding to the housing drains 110*a*, and a plurality of cover drains 150*a* are formed in the outer circumference of the membrane cover 150, corresponding to the housing drains 110*a* and the membrane drains 130*a*.

As shown in FIG. 6B, the exudate drains 300*a* are constructed by combining the biocompatible housing 110, the biocompatible membrane 130 and the membrane cover 150 with each other.

In practice, when the transducer is press-fitted into the round window, a circular fixing part of the transducer cannot be directly inserted into the round window niche, which is frequently not circular with a length ranging from 2 mm to 3 mm and a width ranging from 1 mm to 2 mm. Accordingly, the entrance of the round window niche can be slightly enlarged by a surgical drill corresponding to the diameter of the fixing part of the transducer before the fixing part of the transducer is pushed into the entrance of the round window niche.

In terms of pathology, the round window is an opening that is always open to the middle ear cavity. That is, when the round window driving transducer implanted as above closes the round window, it is impossible to exclude a risk of a side effect, which is not yet known. Further, the round window membrane 40 (see FIG. 5) and the biocompatible membrane 130 may be contaminated by body fluid exuding from the round window because of several reasons such as a disease of the middle ear. Since the vibration characteristics of the exuded body fluid can be changed when the exuded body fluid is coagulated, it is required to cope with such a situation.

Accordingly, the round window driving transducer 300 of this embodiment is constructed with the exudate drains 300*a*, which allow the round window to be partially open and can act as channels to drain the exudate. That is, the exudate flowing to the entrance of the round window can be easily drained out through the exudate drains 300*a*.

While this construction slightly causes to lower the level of membrane vibration and sound radiation, the vibration characteristics are not greatly affected since the membrane 130 is very thin. In consequence, unnecessary fluid can be drained and vibration can be efficiently generated.

Figure 7A:
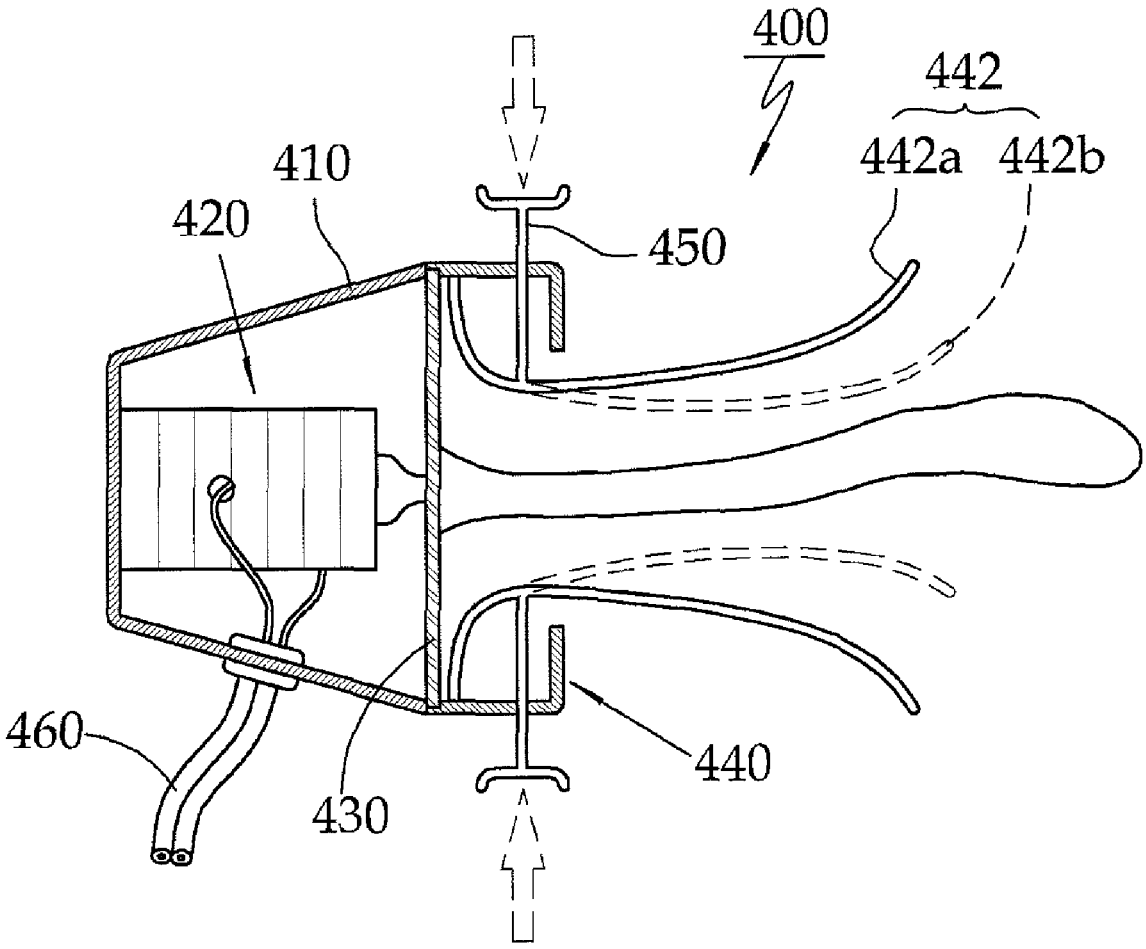
FIG. 7A is a configuration view illustrating the construction of a round window driving transducer according to the fourth embodiment of the present invention.
Figure 7B:
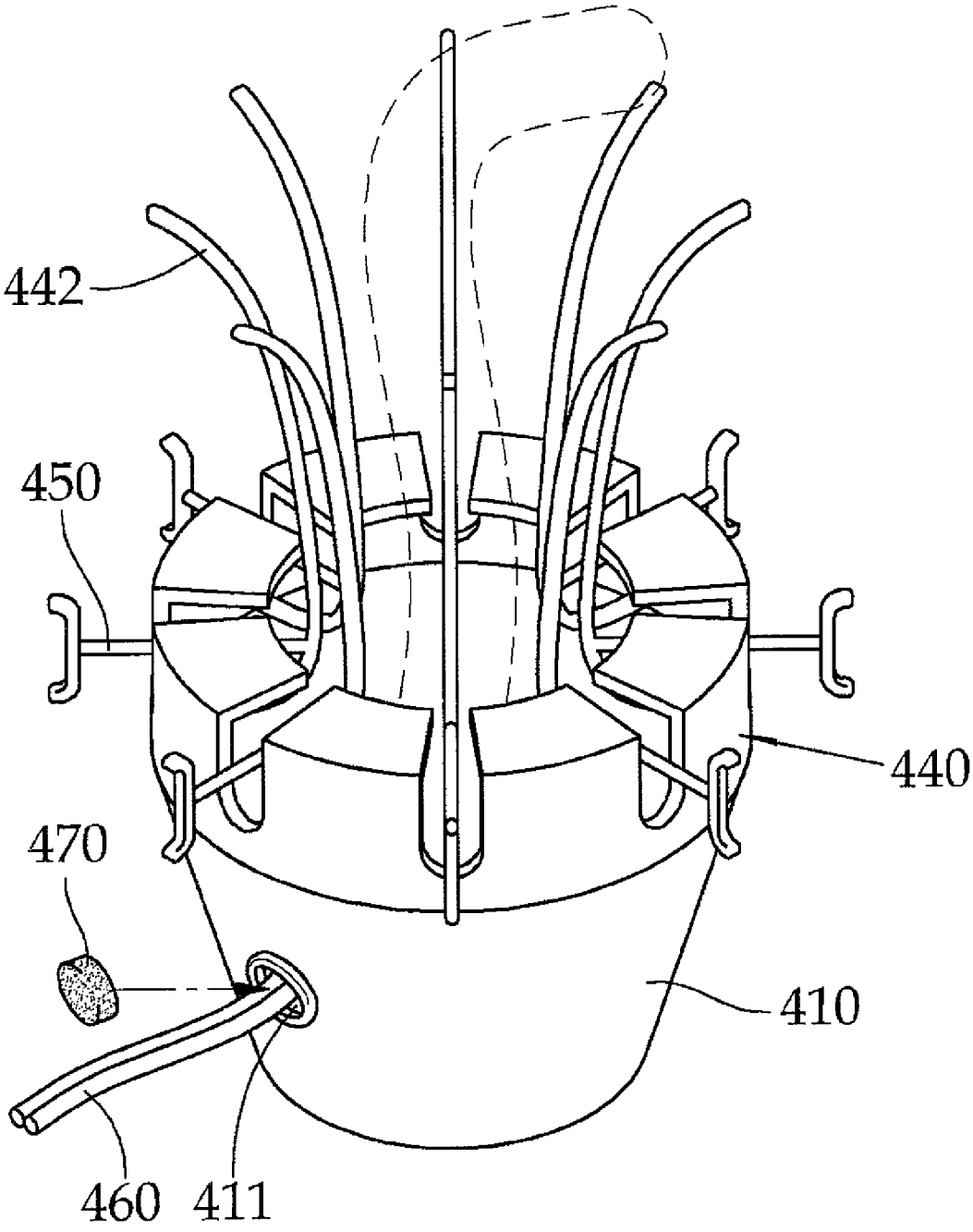
FIG. 7B is a perspective view of FIG. 7A.

In the accompanying drawings, FIGS. 7A and 7B illustrate the construction of a round window driving transducer 400 according to the fourth embodiment of the present invention. Referring to FIGS. 7A and 7B, the round window driving transducer 400 according to the fourth embodiment of the present invention includes a biocompatible housing 410 having an inner space, a piezoelectric vibrator 420, a biocompatible membrane 430, a membrane cover 440, a plurality of push levers 450, power cords 460 and a hermetic sealing terminal 470. The biocompatible housing 410 has an opening in the top portion thereof and a through-hole 411 in a lateral side thereof. The piezoelectric vibrator 420 is placed inside the housing 410 and has a connecting pin 421 at one end thereof. The biocompatible membrane 430 is in contact with the connecting pin 421 and is configured to be vibrated by the piezoelectric vibrator 420 to apply vibration to the round window membrane 40 (see FIG. 5). The membrane cover 440 covers the top surface of the biocompatible housing 410 and has a plurality of lever grooves 441, which extend from the inner circumference to the outer circumference thereof and are spaced apart from each other at a predetermined interval, and elastic support pins 442, each of which is provided inside a respective one of the lever grooves 441. Each of the push levers 450 is inserted into a respective one of the lever grooves 441 and is connected to a respective one of the elastic support pins 442. The power cords 460 are connected from outside through the through-hole 411 of the biocompatible housing 410 to supply power to the piezoelectric vibrator 420. The sealing terminal 470 hermetically seals the through-hole 411 of the housing 410 through which the power cords 460 are inserted into the housing 410.

The round window driving transducer 400 of this embodiment has substantially the same construction as the round window driving transducers 100 to 300 of the first to the third embodiments, except for the structure of the membrane cover 440, the push levers 450 and the elastic support pins 442. This is because a device part of the transducer 400 inserted into the entrance of the round window is different from those of the round window driving transducers 100 to 300.

Specifically, external force is applied to the elastic support pins 442, acting as a spring, so as to straighten the elastic support pins 442 from the bent position. The external force is then removed after the straightened support pins 442 are fixed to the round window niche. In this way, the elastic support pins 442 can be easily fixed to the round window niche.

In more detail, the lever grooves 441 are deeply dug in the membrane cover 440 so as to allow the movement of the elastic support pins 442, which are normally pulled back by elasticity as indicated with solid lines 442*a* in FIG. 7A. This pulled-back position indicates a fixed position of the transducer 400, which is inserted into the entrance of the round window. The transducer 400 is properly fixed to the entrance of the round window by the spring force of the elastic support pins 442, which is applied onto the round window.

When the transducer 400 is being inserted into the entrance of the round window, an operator applies force to the push levers 450 connected to the elastic support pins 442 by winding a string around the push levers 450 or using a fixing tool (not shown) such as small round pliers, so that the push levers 450 push the elastic support pins 442 toward the center of the entrance of the round window. Then, the elastic support pins 442 are transformed into the position as indicated with dotted lines 442*b* in FIG. 7B, thereby facilitating the insertion of the transducer 400. Once the transducer 400 is inserted into the round window, the operator will remove the string or the pliers from the push levers 450, so that the elastic support pins 442 can be pulled back to the original position, thereby fixing the transducer 400 to the round window.

Figure 8A:
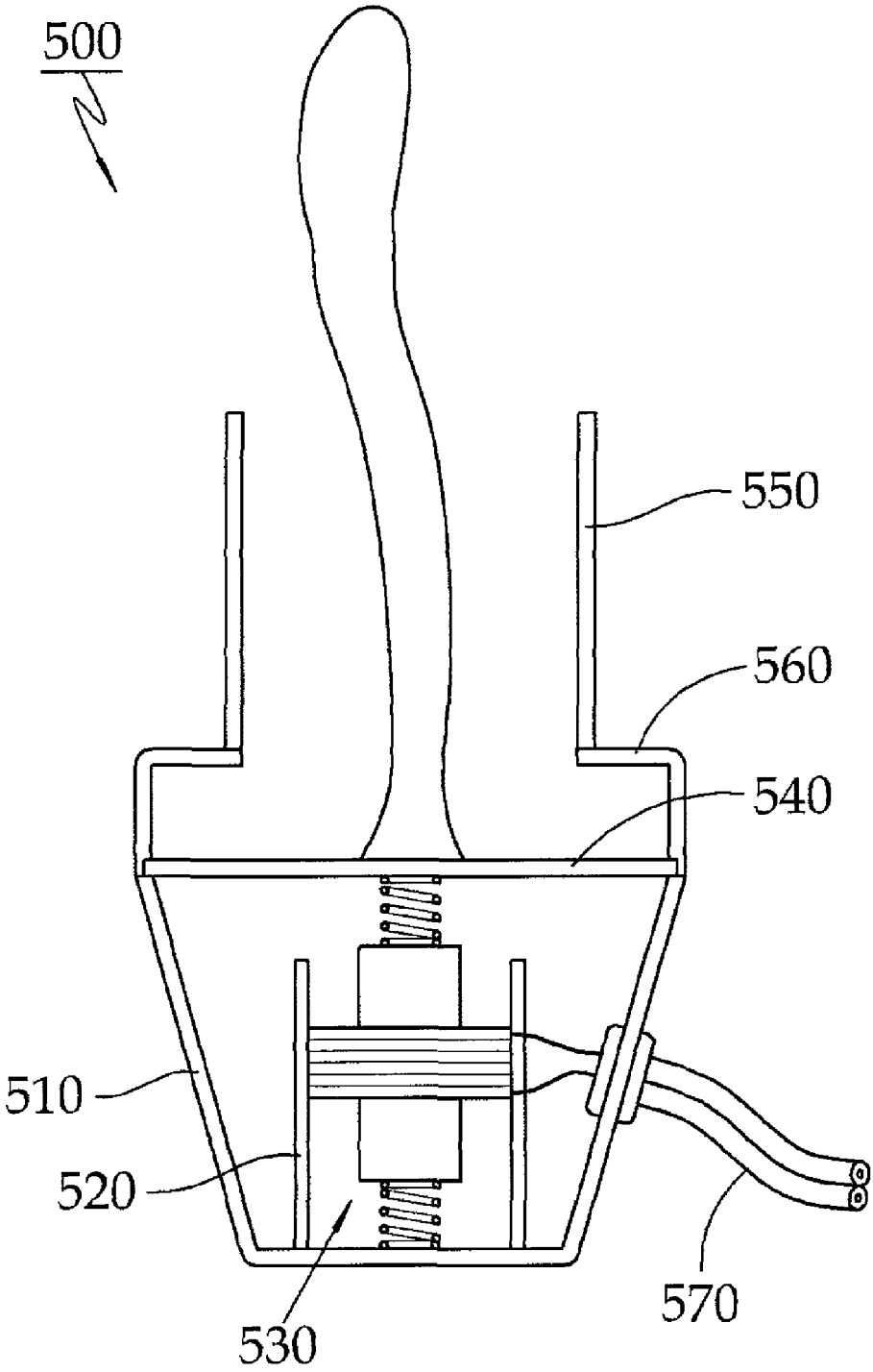
FIG. 8A is an assembled configuration view illustrating the construction of a round window driving transducer according to the fifth embodiment of the present invention.
Figure 8B:
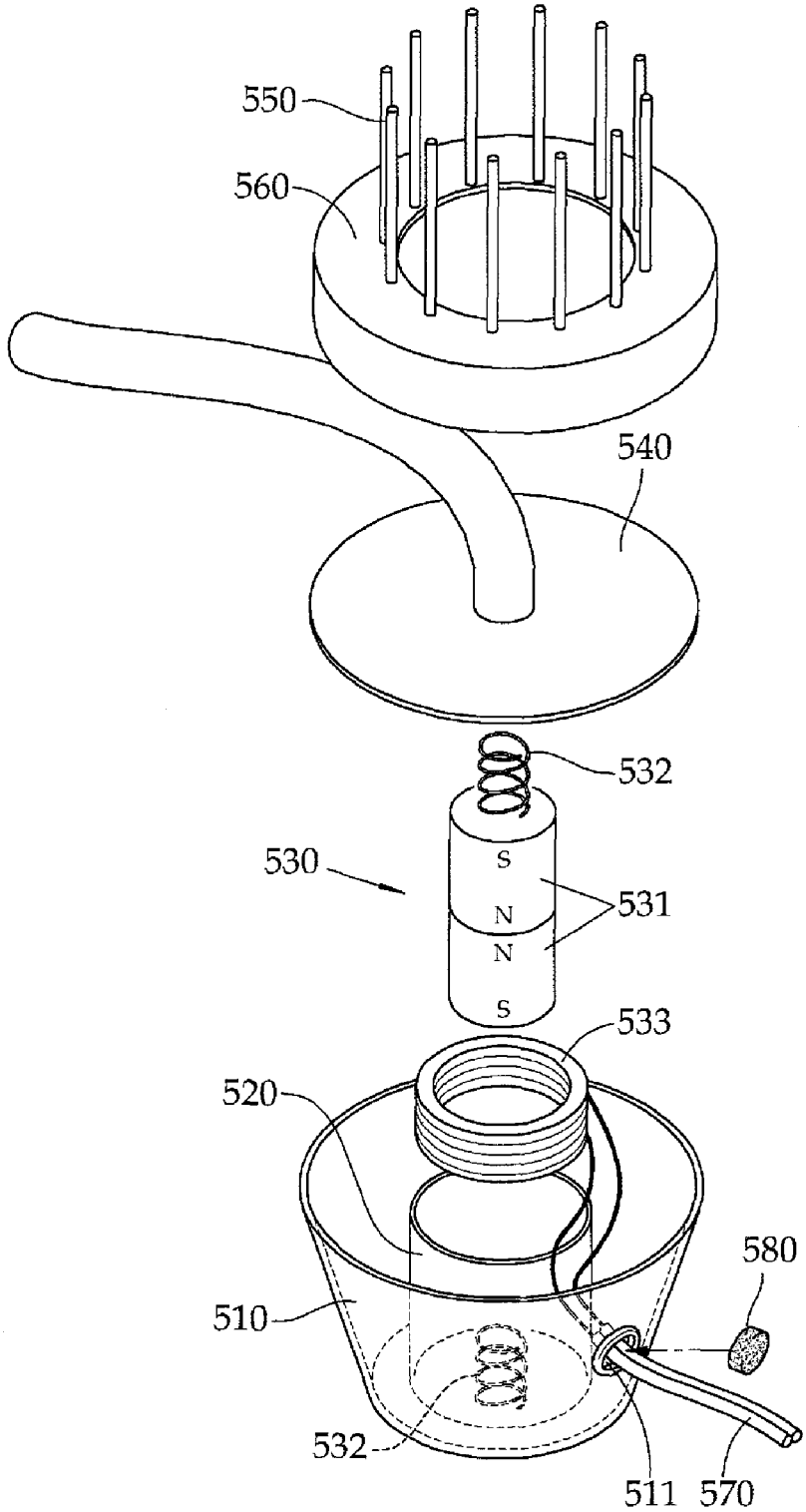
FIG. 8B is an exploded perspective view of FIG. 8A.

In the accompanying drawings, FIG. 8A is an assembled configuration view illustrating the construction of a round window driving transducer 500 according to the fifth embodiment of the present invention, and FIG. 8B is an exploded perspective view of FIG. 8A.

Referring to FIGS. 8A and 8B, the round window driving transducer 500 of the fifth embodiment of the present invention includes a biocompatible housing 510 having an inner space, an inner housing 520 placed inside the biocompatible housing 510, an electromagnetic vibrator 530 fitted inside the inner housing 520, a biocompatible membrane 540, a membrane cover 550, power cords 570 and a hermetic sealing terminal 580. The biocompatible housing 510 has an opening in the top portion thereof and a through-hole 511 in a lateral side thereof. The inner housing 520 has an inner space and is open in the top portion thereof. The biocompatible membrane 540 is in contact with the top portion of the electromagnetic vibrator 530 and is configured to generate vibration and apply the vibration to the round window membrane 40 (see FIG. 5). The membrane cover 550 is configured to cover the top surface of the biocompatible housing 510, and has a plurality of fixing pins 560 extending from the inner circumference thereof. The power cords 570 are connected from outside through the through-hole 511 of the biocompatible housing 510 to supply power to the electromagnetic vibrator 530. The sealing terminal 580 hermetically seals the through-hole 511 of the housing 510 through which the power cords 570 are inserted into the housing 510.

The round window driving transducer 500 of the fifth embodiment of the present invention has substantially same construction as the round window driving transducers 200 and 300 of the second and third embodiments, except that the electromagnetic vibrator 530 is employed in place of the piezoelectric vibrator.

The electromagnetic vibrator 530 is constructed with a pair of magnetic members 531, a pair of elastic members 532 supporting the magnetic members 531 and a solenoid coil 533. The magnetic members 531 are placed inside the inner housing 520 in order to reduce an influence from an external magnetic field, and are stacked on each other, with the same polarity ends thereof facing each other. In order to support the magnetic members 531, one of the elastic members 532 is placed on the underside of the lower one of the magnetic members 531, and the other one of the elastic members 532 is placed on the top surface of the upper one of the magnetic members 531. The solenoid coil 533 is placed inside the inner housing 520 and is fitted on the outer circumference of the magnetic members 531.

Here, the fixing pins 560 have a circular cross-sectional shape.

Figure 9:
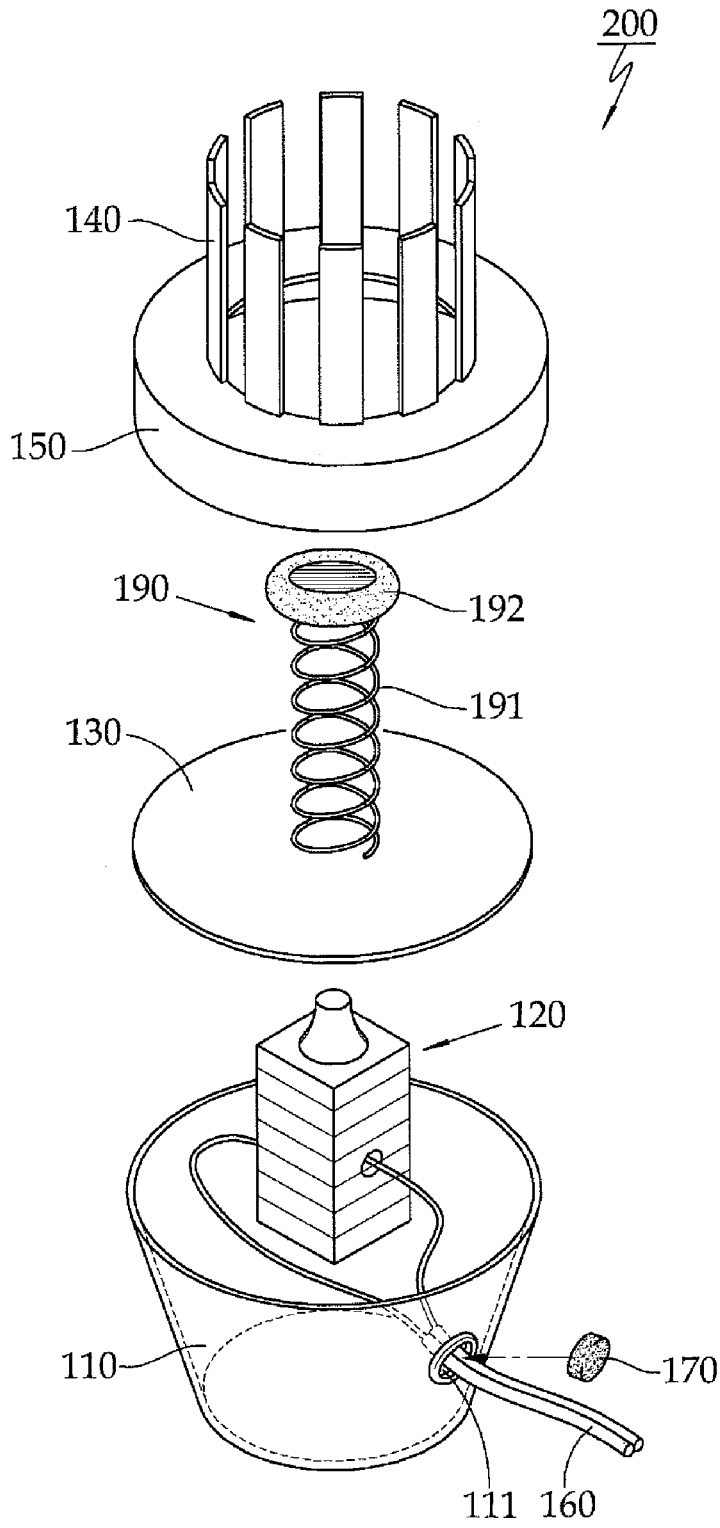
FIG. 9 is an exploded perspective view illustrating a round window driving transducer to which a vibration-transmitting member according to the present invention is applied.
Figure 10:
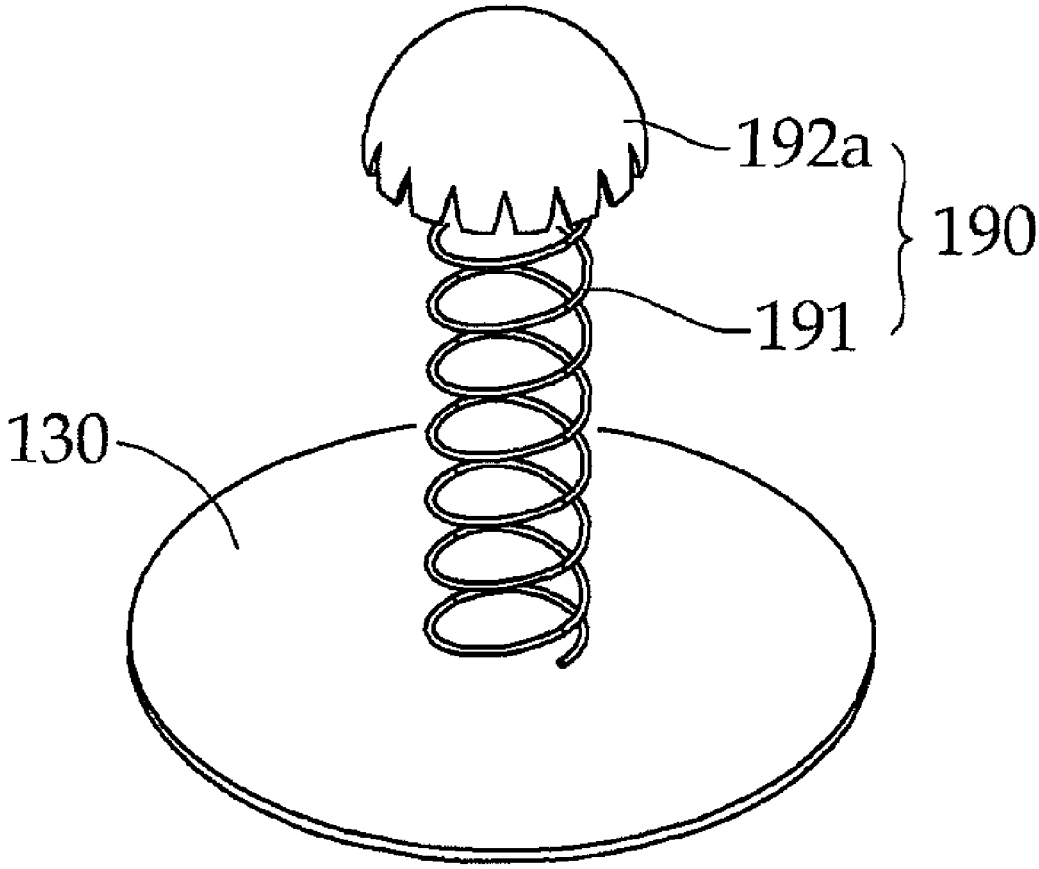
FIG. 10 is a schematic perspective view illustrating vibration-transmitting member according to the present invention.

In the accompanying drawings, FIG. 9 is an exploded perspective view illustrating a round window driving transducer 200 to which a vibration-transmitting member 190 according to the present invention is applied, and FIG. 10 is a schematic perspective view illustrating vibration-transmitting member 190 according to the present invention.

The vibration-transmitting member 190 of this embodiment includes a helical spring 191, which is used as an elastic member in place of the above-described silicone-based elastic member. The helical spring 191 is constructed with Steel Use Stainless 316L (SUS-316L) or any steel with an equivalent level.

In the vibration-transmitting member 190, the helical spring 191 is fixed to the top surface of the biocompatible membrane 130, and a finishing portion 192 is coupled to the distal end of the helical spring 191.

As shown in FIG. 9, the finishing portion 192 can be made of biocompatible silicone in order not to damage the round window membrane. As shown in FIG. 10, a contact cap 192*a* made of titanium or biocompatible material can replace the finishing portion 192. Here, the contact cap 192*a* can preferably have a smooth curvature in order to minimize contact pressure applied to the round window membrane.

Preferably, in the round window driving transducer of the foregoing embodiments, the diameter of the bottom of the biocompatible housing ranges from 1.5 mm to 2.5 mm, the diameter of the portion in contact with the bone of the round window niche ranges from 3 mm to 5 mm, and the height from the bone surface of the round window niche to the biocompatible housing of the transducer ranges from 2 mm to 4 mm.

In the implantable hearing device, the round window driving transducer has the following advantages:

The round window driving system creates less acousto-mechanical load, caused by the ossicle, the tympanic membrane and the ligament, than the oval window driving system does. This means that the round window driving system does not cause amplitude reduction in high frequency vibration since the round window driving system has a much less mass to drive than the oval window driving system does and is not affected by the compliance of the tympanic membrane or the load of the ligament For these reasons, high frequency characteristics of the round window driving system of the present invention are much better than those of other driving systems using conventional transducers, and thus the round window driving system of the present invention can be more advantageously used in implantable hearing device for patients with sensorineural hearing loss whose hearing degrades in high frequency ranges.

Figure 11:
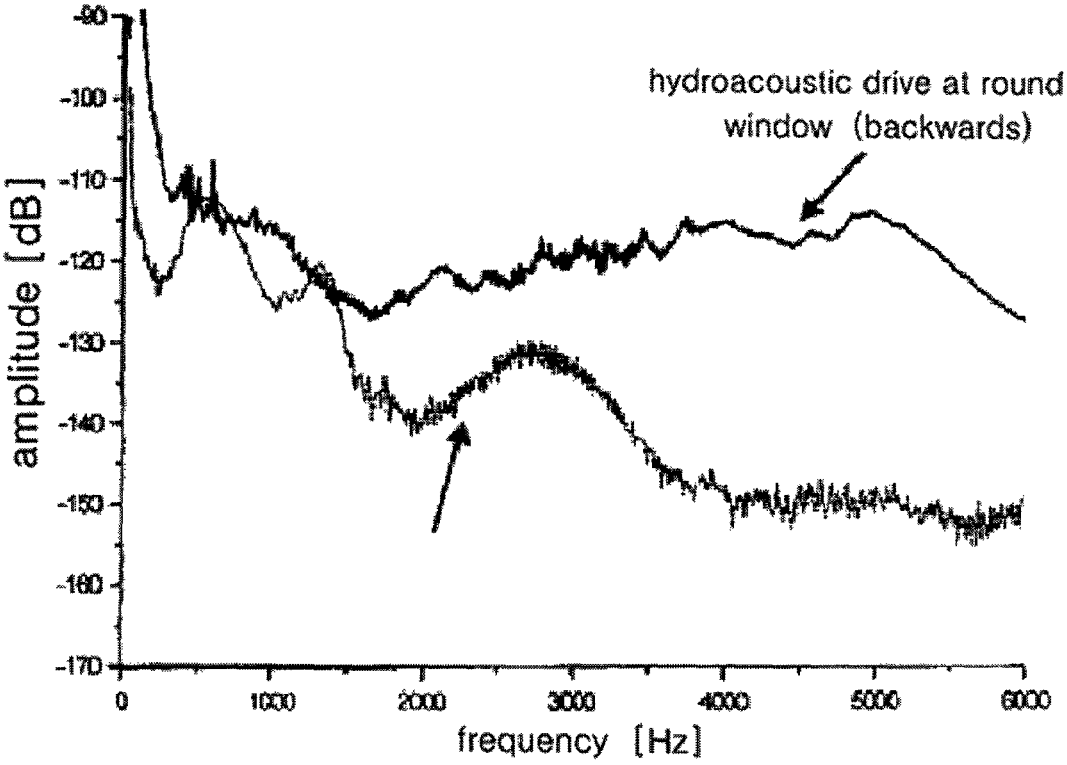
FIG. 11 is a graph illustrating comparison test results performed by H professor team of Dresden University, Germany, using a vibration transducer, which directly stimulates the round window, and a conventional air conduction hearing aid.

FIG. 11 is a graph illustrating comparison test results performed by H professor team of Dresden University, Germany, using a transducer, which directly stimulates the round window, and a conventional air conduction hearing aid. In the graph, the displacements of the stapes and the vibration displacements of the round window membrane are plotted.

Referring to FIG. 11, a frequency band profile obtained from the transducer implanted in the round window is much flatter than that obtained from the conventional air conduction hearing aid. This means that round window driving transducer has excellent high frequency characteristics.

As set forth above, the transducer of the present invention is not constructed to vibrate as a reaction to the vibration of the magnet inside the cylindrical case as in the floating mass transducer proposed by Ball. The construction of transducer of the present invention is also different from the construction as proposed by Berrang et al., which includes at least one vibration-reflecting mass provided at one end of the multilayer transducer and the enclosed housing and is designed to vibrate the bone adjacent to the three semicircular canals.

Further, the construction of transducer of the present invention is distinct from the implantable middle ear, disclosed in U.S. Pat. No. 4,988,333 to Engebretson et al, in which fluid is filled in the tube and a diaphragm is vibrated. Moreover, the transducer of the present invention has a fixing structure that allows the vibration membrane to be easily installed in the entrance of the round window. Accordingly, the transducer of the present invention is also different from the system of Otologics, in which a driver tip driven by the electromagnetic vibrator is connected to the ossicle of the middle ear, or the system of St. Croix Medical, in which a structure surrounding the piezoelectric transducer is connected, at one end thereof, to the outer wall of the middle ear cavity and, at the other end thereof, to a vibration driver tip, which is in turn connected to the ossicle.

While the present invention has been described with reference to the particular illustrative embodiments and the accompanying drawings, it is not to be limited thereto but will be defined by the appended claims. It is to be appreciated that those skilled in the art can substitute, change or modify the embodiments in various forms without departing from the scope and spirit of the present invention.

What is claimed is:

1. A round window driving transducer comprising:

a biocompatible housing having an inner space, an opening in a top portion thereof and a through-hole in a lateral side thereof;

a piezoelectric vibrator placed inside the housing, and having a connecting pin at an end thereof;

a biocompatible membrane in contact with the connecting pin, wherein the biocompatible membrane is vibrated by the piezoelectric vibrator and is adapted to apply vibration to a round window membrane;

a membrane cover covering a top surface of the biocompatible housing, and having a plurality of fixing pins extending from inner circumferential portions thereof;

power cords connected from outside through the through-hole of the biocompatible housing so as to supply power to the piezoelectric vibrator; and a hermetic sealing terminal hermetically sealing the through-hole of the housing through which the power cords are inserted into the housing.

2. The round window driving transducer according to claim 1, further comprising a vibration-transmitting member coupled to the biocompatible membrane, the vibration-transmitting member helping the vibration from the biocompatible membrane be transmitted to the round window membrane.

3. The round window driving transducer according to claim 2, wherein the vibration-transmitting member comprises an elastic body made of silicone.

4. The round window driving transducer according to claim 2, wherein the vibration-transmitting member includes:

a helical spring fixed to the top surface of the biocompatible housing; and a finishing portion coupled to a distal end of the helical spring.

5. The round window driving transducer according to claim 4, wherein the finishing portion is made of biocompatible silicone.

6. The round window driving transducer according to claim 4, wherein the finishing portion comprises a contact cap made of titanium or biocompatible material.

7. The round window driving transducer according to claim 1, wherein the fixing pins are made of shape memory alloy or shape memory resin, wherein the shape memory alloy contains titanium and nickel, and the shape memory resin is composed of polymer.

8. The round window driving transducer according to claim 1, further comprising a plurality of exudate drains, which include:

a plurality of housing drains formed in outer circumferential portions of the biocompatible housing;

a plurality of membrane drains formed in outer circumferential portions of the biocompatible membrane, corresponding to the housing drains; and a plurality of cover drains formed in outer circumferential portions of the membrane cover, corresponding to the housing drains and the membrane drains, wherein the housing drains, the membrane drains and the cover drains form the exudate drains when the biocompatible housing, the biocompatible membrane and the membrane cover are combined with each other.

9. The round window driving transducer according to claim 1, wherein the piezoelectric vibrator comprises a single piezoelectric element or a multilayer piezoelectric element.

10. The round window driving transducer according to claim 9, wherein the piezoelectric element is made of piezoelectric material capable of generating high efficiency vibration, and has an area less than 1 $mm^2$ and a length less than 2 mm.

11. The round window driving transducer according to claim 1, wherein the fixing pins have a quadrangular or circular cross section.

12. An implantable hearing device comprising:

a round window driving transducer comprising:

a biocompatible housing having an inner space, an opening in a top portion thereof and a through-hole in a lateral side thereof;

a piezoelectric vibrator placed inside the housing, and having a connecting pin at an end thereof;

a biocompatible membrane in contact with the connecting pin, wherein the biocompatible membrane is vibrated by the piezoelectric vibrator and is adapted to apply vibration to a round window membrane;

a membrane cover covering a top surface of the biocompatible housing, and having a plurality of fixing pins extending from inner circumferential portions thereof;

power cords connected from outside through the through-hole of the biocompatible housing so as to supply power to the piezoelectric vibrator; and a hermetic sealing terminal hermetically sealing the through-hole of the housing through which the power cords are inserted into the housing.

* * * * *